US005241941A

United States Patent [19]

Hancock et al.

[11] Patent Number: 5,241,941

[45] Date of Patent: Sep. 7, 1993

[54] IGNITION COIL

[75] Inventors: Robert L. Hancock, Ann Arbor; Steven E. Pritz, Westland; Robert C. Bauman, Flat Rock, Shawn J. Nowlan, Ypsilanti, all of Mich.

[73] Assignee: Ford Motor Company, Dearborn, Mich.

[21] Appl. No.: 939,800

[22] Filed: Sep. 3, 1992

[51] Int. Cl.[5] ..... F02P 11/00

[52] U.S. Cl. ..... 123/634; 336/110

[58] Field of Search ..... 123/634, 647, 635, 633, 123/169 PA; 336/84 M, 110, 155

[56] References Cited

U.S. PATENT DOCUMENTS

| | | | |
|---|---|---|---|
| 3,209,295 | 9/1965 | Baerman | 336/155 |
| 4,546,753 | 10/1985 | Pierret | 123/634 |
| 4,834,056 | 5/1989 | Kawai | 123/634 |
| 4,841,944 | 6/1989 | Maeda et al. | 123/647 |
| 4,893,105 | 1/1990 | Maeda et al. | 336/84 M |
| 4,903,674 | 2/1990 | Bassett et al. | 123/634 |
| 4,990,881 | 2/1991 | Ooyabu | 336/110 |
| 5,036,827 | 8/1991 | Shimada et al. | 123/634 |
| 5,038,745 | 8/1991 | Krappel et al. | 123/635 |
| 5,101,803 | 4/1992 | Nakamura et al. | 123/634 |
| 5,144,935 | 9/1992 | Taruya et al. | 123/633 |
| 5,146,906 | 9/1992 | Agatsuma | 123/634 |
| 5,170,767 | 12/1992 | Wada et al. | 123/633 |
| 5,170,768 | 12/1992 | Eilaraas | 123/634 |
| 5,186,154 | 2/1993 | Takaishi et al. | 123/634 |
| 5,191,872 | 3/1993 | Takaishi | 123/647 |

*Primary Examiner*—Raymond A. Nelli

*Attorney, Agent, or Firm*—Roger L. May; Richard D. Dixon

[57] ABSTRACT

An ignition coil having annular primary and secondary coils, the primary coil wound around a central core member and including a permanent magnet made of a magnetic material that is less than fully dense, and is interposed between one end of the central core member and one end of a C-shaped iron core surrounding the primary and secondary coil assembly and assuring the elimination of any air gap between the C-shaped iron core and the central core member.

23 Claims, 5 Drawing Sheets

IGNITION COIL

TECHNICAL FIELD

This invention relates to ignition coils, particularly modularly constructed, permanent magnet-type ignition coils for vehicular ignition systems.

BACKGROUND OF INVENTION

In use in popular ignition systems for internal combustion engines is an ignition coil or coils having a C-shaped iron core within a non-conductive housing, with the primary and secondary windings wound on individual bobbins inter-nested within one another and lying within the boundaries of the C-shaped iron core. The coil is filled with epoxy potting material or other insulating material as a final step in the process. Despite being filled with epoxy, the gap between the ends of the legs of the C-shaped iron core are referred to as an "air gap". It is also known that the efficiency can be increased and compactness of the overall coil structure, including the housing, can be reduced by nearly filling the air gap portion of the aforementioned iron core with a permanent magnet. Such a coil construction is shown in U.S. Pat. No. 4,990,881. Part of the success in making such a coil design commercially practical has been the discovery of a very strong permanent magnetic material containing such elements as samarium (Sm), neodymium (Nd), and other similar rare earth, high energy materials. The permanent magnet used is made entirely of such material and referred to as "fully dense". The air gap of the iron core of the ignition coil, although reduced by insertion of the magnet, is still retained in the design of the aforementioned coil.

In contrast, in the subject invention a permanent magnet-type ignition coil is provided having preferably no air gap and also assuring that should there be a small air gap due to component tolerance stack-up it will be in a predetermined location thereby enhancing considerably the efficiency and power output of the coil. This allows for a substantial reduction in the size of the overall unit for acquiring the same unit power output. A further feature of the subject invention is the design and use of a permanent magnet composed of a bonded magnetic material, which is less than fully dense, made of these most recently available rare earth, high energy materials such as samarium and neodymium, thereby providing a material which is equally effective, but far less expensive than the fully dense permanent magnet heretofore used, and having the added benefit that its thickness, including the magnetizing alloy elements Nd or Sm or equivalent, provides for less expensive fabrication and easier handling during assembly of the coil.

SUMMARY OF INVENTION

The subject invention therefore contemplates an improved permanent magnet-type electromagnetic coil of the lightest weight and smallest size for its performance.

The invention further contemplates an electromagnetic ignition coil of the type described utilizing a rare earth, high energy magnetic material for the permanent magnet which is substantially less than fully dense, and therefore is less expensive than a magnet made of fully dense material and also completely eliminates the need for any air gap between the permanent magnet and the iron core, which in turn results in the maximum efficiency of the permanent magnet-type coil design.

The invention further contemplates an ignition coil of the type described above wherein the permanent magnet member includes means for virtually eliminating the air gap throughout the complete range of dimensional tolerances on each of the coil components contributing to the existence or non-existence of the air gap.

The invention further contemplates an ignition coil assembly of modular construction and wherein the construction of the components provides means for insulating the iron core thermally from the epoxy filler material, such that the possibility of thermal stress cracks between the core and the primary and/or secondary windings are eliminated, and wherein the bobbin for both the primary and secondary windings are cylindrical, thereby allowing the winding of the coils onto the bobbin with even tension, and wherein the cylindrical bobbin for the primary winding is provided with flow-through passages thereby allowing the epoxy material to quickly and completely fill and insulate the windings from both sides of the bobbin, and wherein the terminals leading to and from the primary and secondary coils require no soldering, and wherein the retainer bushings which are injection-molded into the coil housing include means for precluding the relative displacement of the bushing with respect to the housing in both the radial and axial directions.

The invention further contemplates a boot at the secondary coil output terminal end of the coil having means for retaining the retention spring within the boot but requiring no mechanical connection between the boot and the spring, and likewise allowing the customary insertion and retention of the spark plug within the boot.

These and other features, objects and advantages, of the present invention are readily apparent from the following detailed description of the best mode for carrying out the invention when taken in connection with the accompanying drawings.

BEST MODE FOR CARRYING OUT THE INVENTION

Figure 1:
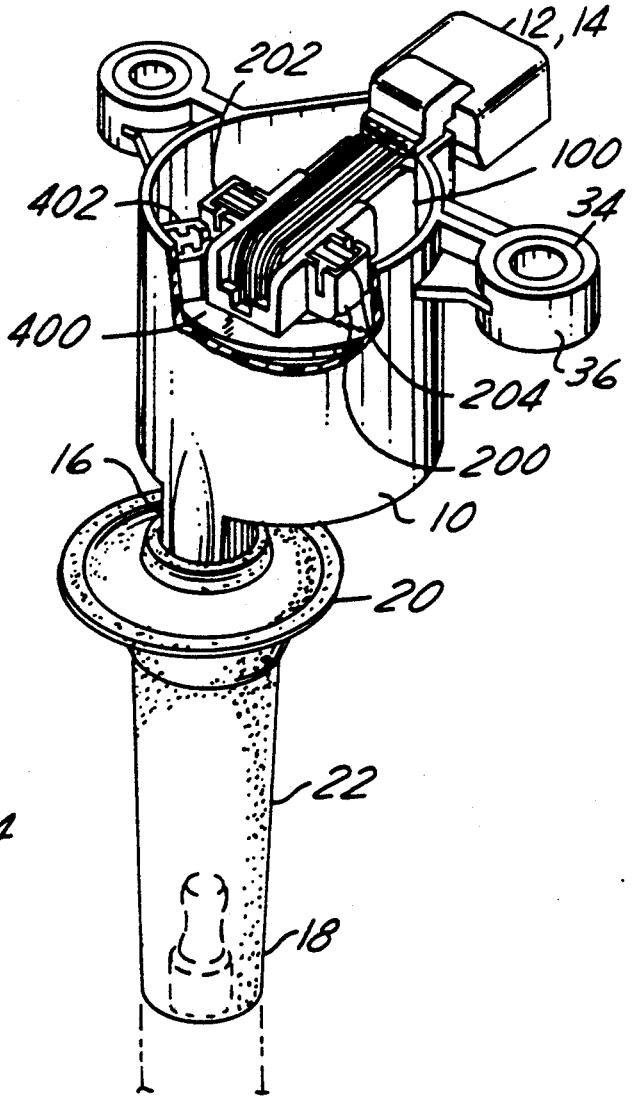
FIG. 1 is a general perspective view of the ignition coil assembly in accordance with the present invention and with potting material removed and the primary connector assembly in partial section.
Figure 5:
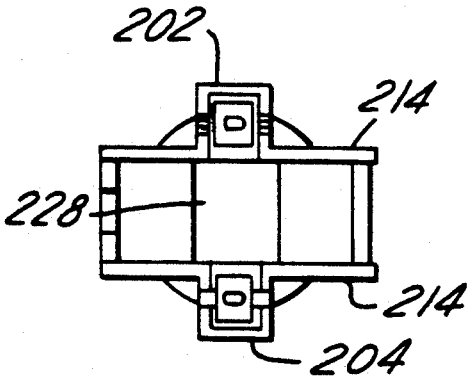
FIG. 5 is a plan view of the primary bobbin and winding assembly seen from the upper end thereof.
Figure 3:
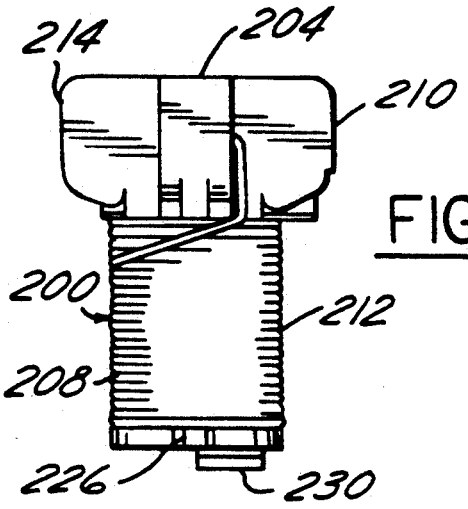
FIG. 3 is an elevation view of the primary winding and bobbin assembly in accordance with the present invention.

In FIG. 1 is shown the overall assembly of the ignition coil assembly of the present invention. The ignition coil is a coil-per-plug type ignition coil assembly mounted upon and electrically connected to a typical ignition spark plug as shown in phantom. It will be noted that the ignition coil assembly is extremely compact. It includes a generally annular housing 10 within which is nested a steel laminated C-shaped core member 100 which provides an open cavity portion or air gap between its terminal ends, and with a primary and secondary bobbin assembly 200, 400 residing within the cavity portion between the terminal ends of the C-shaped core member 100. The primary coil member 200 includes a T-shaped steel laminated core member (not shown) extending axially through the primary bobbin.

The primary bobbin includes a pair of primary terminal receptacles 202, 204 within which are located solderless, spring-retained, insulation displacement terminals.

A primary connector assembly 12, partially shown, is adapted to clip onto the housing and includes leads in a receptacle portion 14 which establishes electrical connection across the primary and secondary coils in a manner to be described below.

The secondary bobbin 400 includes an input terminal 402 and a corresponding secondary bobbin output terminal (not shown in FIG. 1) which is located at the lower end of the secondary bobbin within the area of the terminal stem portion 16 of the housing. Slip-fit over the terminal stem portion 16 is a flexible rubber boot 18 having a collar 20 Which grips the stem portion 16 and a barrel portion 22 adapted to grip and establish electrical connection with a spark plug head in a manner described below.

Figure 2:
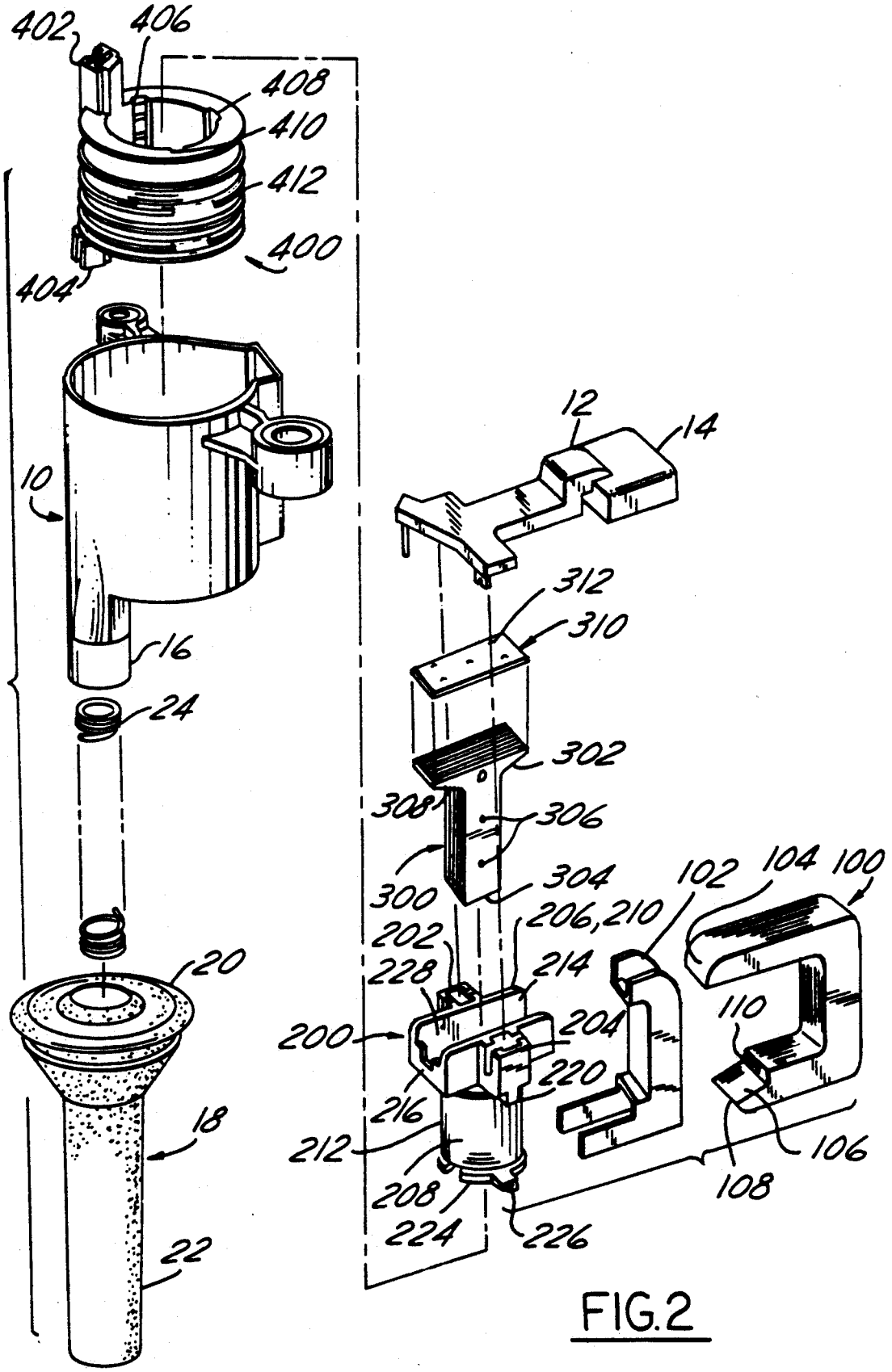
FIG. 2 is a perspective, exploded view of the ignition coil assembly shown in FIG. 1.

FIG. 2 further illustrates the unique compactness of the ignition coil assembly, and the manner in which it is assembled in unique modular assembly form. For example, the primary bobbin subassembly 200 includes a primary bobbin 206 having a primary coil 208 wound around the longitudinal axis thereof. The bobbin 206 includes an upper channel-shaped head portion 210 and a lower annular portion 212. The bobbin includes a rectangularly shaped bore 228 extending along the longitudinal axis thereof from one end to the other and sized to receive, in sliding fit, the T-shaped steel laminated core member 300. The upper channel section of the bobbin includes a pair of spaced side walls 214 and a stop wall 216 at one end thereof, extending between the side walls. The upper channel section includes three locating lugs 218, 220, 222, (218 and 222 not shown in this view). Two of these (218, 220) are located at the bottom of the respective terminal receptacles 202, 204. At the bottom of the primary bobbin is located an annular collar 224 and radially projecting from the collar is a pair of similar locating lugs 226 axially aligned with those extending from the terminal portions 202, 204 of the upper portion of the bobbin.

The T-shaped core member 300 which is slidingly received within the primary bobbin assembly 200 includes a cross-bar member 308 having tapered under sides 302 at one end and a tapered end or ramp 304 at its other end. The T-shaped core member is a series of steel laminations secured together by punched or stamped stakes 306.

Magnetically attached to the cross-bar portion 308 is a plate-like permanent magnet 310. It includes a plurality of protrusions 312 on its upper surface. The height or length of each equally or slightly exceeding the maximum differential in stack-up tolerances governing the filling of the distance between the terminal ends of the C-shaped core member by the T-shaped core member and permanent magnet. The magnet member is made of a bonded magnetic material which is substantially less than fully dense. It is made of grains of rare earth, high energy materials such as neodymium and samarium evenly dispersed within a binder, such as a plastic or epoxy matrix. In our preferred example, noedymium grains are dispersed within a nylon matrix such that the resulting composite material has a flux density of 4.2 kilogauss, whereas a fully dense magnet would have a flux density of 12 kilogauss.

The primary coil bobbin assembly 200 is adapted to be received within the annular secondary coil bobbin assembly 400. The secondary coil bobbin assembly includes integral secondary terminal portions 402 and 404. Within the end of each terminal portion is located a similar solderless spring-retained insulation terminal. Located about the inner cylindrical surface of the secondary terminal are three longitudinally extending slots 406, 408, 410, each being open to the coil winding 412 which is wound about the outer periphery of the secondary coil bobbin member 400 and connected about its respective ends to input and output secondary terminal portions 402, 404. The width of the slots 406, 408, 410 matches that of the locating lugs 218, 220, 222 respectively of the primary bobbin assembly. Thus, when the primary bobbin is inserted within the secondary bobbin, it is uniquely located within the secondary bobbin by keying the circumferential location of each locating lug. Also, the relative longitudinal location is fixed by virtue of the tapered undersides of the upper channel portion of the bobbin coming to rest on the edge or lip of the secondary bobbin. Further, the slots 406, 410 on the secondary bobbin have tabs 418 on the underside of the bobbin. As the upper channel portion of the primary bobbin comes to rest on the lip of the secondary bobbin, the protrusions 232 on the locating lugs 226 engage the tabs 418, thus snapping the primary bobbin in place.

Next, the plastic terminal insulating clip member 102, made of modified polypropylene with 10% filler, or other suitable material, is slid within the open cavity of the C-shaped core member 100. The clip is sized such that the side walls thereof firmly grip the outer walls of the C-shaped core member, as shown and described below.

Next, the C-shaped core member loop with clip 102, is inserted from its open end within the channel-shaped shaped upper head portion of the primary bobbin such that the upper terminal end 104 of the C-shaped core member will come to rest against the stop wall 216 of the primary bobbin. At the same time, the ramp or inclined end portion 304 of the T-shaped core member within the primary bobbin assembly will engage in line-to-line contact along the corresponding ramp end portion 106 of the C-shaped core member at its other terminal end 108. The assembly continues until the T-shaped core member abuts the stop shoulder 110 of the C-shaped core member. Further, the degree of lift designed into the inclined ramp, is also designed to force the T-shaped core member 300 and permanent magnet 310 into full contact with the other terminal end portion of the C-shaped core member 100, thus virtually eliminating any air gap which might otherwise exist between the C-shaped core member and the T-shaped core member.

By virtue of the protrusions 312 extending from the permanent magnet, some degree of physical contact between the permanent magnet and T-shaped core member on the one hand and the end 104 of the C-shaped core member is always guaranteed. This in turn assures that there will always exist at the other end line contact across the interengaging ramp surfaces 304, 106 of the core members 300, 100, respectively.

Next, the core and primary and secondary bobbin sub-assembly is slid within the housing 10. Thereafter, the boot assembly including the retainer spring 24 is slip-fit onto the one end of the housing and the primary connector assembly 12 is clipped onto the opposite end of the housing. This completes the core assembly, as shown in FIGS. 1 and 2.

Figure 4:
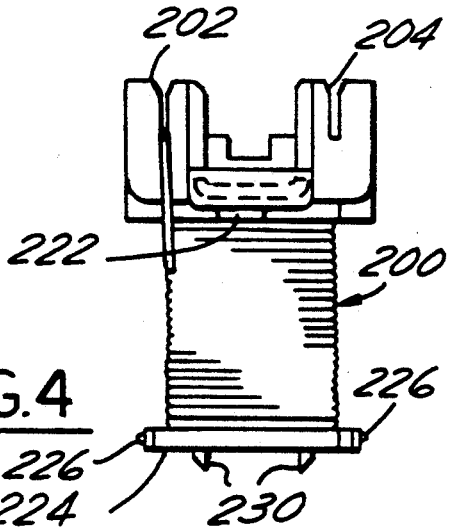
FIG. 4 is a view similar to FIG. 3 and rotated 90 to show further detail of the primary bobbin and winding assembly in accordance with the present invention.
Figure 6:
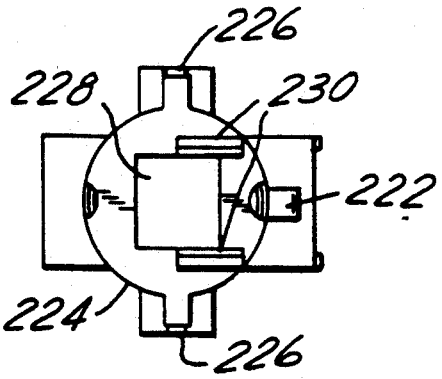
FIG. 6 is a plan view of the primary bobbin and winding assembly shown in FIGS. 3 and 4, as viewed from the bottom end thereof.

In FIGS. 3–6 are shown the details of the primary coil bobbin. The primary coil bobbin 200 is a conventional injection molded member made of nylon, or other suitable material, and includes a channel-shaped head portion 210 and lower annular reel portion 212 upon which is spirally wound a primary coil 208. Through the center of the bobbin is a rectangular cross-sectioned bore 228 for receiving the T-shaped core member in sliding fit engagement. Upper locating lug 222 is shown in FIG. 4 as well as the lower locating lugs 226 as shown in FIG. 6, which are located longitudinally opposite the respective upper locating lugs 218, 220. Further, it will be noted that extending within the same transverse direction as the channel-shaped upper member, is a pair of guide rails 230 located on the bottom collar 224. The guide rails 230 extend transversely over the portion of the rectangular bore 228 and are spaced from one another a distance slightly greater than the width of the C-shaped core member. The guide rails 230 serve to receive the lower terminal portion 108 of the C-shaped core member 100 as it is being slipped into engagement with the primary and secondary bobbin assemblies.

Thus, the primary bobbin assembly is uniquely constructed such that the relative position of the bobbin member with the C-shaped core on the one hand and the secondary bobbin assembly on the other, can only be accomplished in one particular orientation. Misassembly is thereby eliminated.

Figure 10:
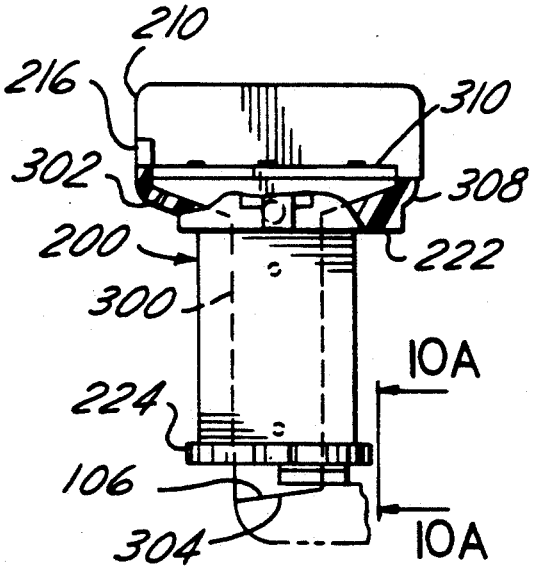
FIGS. 10 and 10a are an elevation view, shown partially in section, of the primary bobbin and winding assembly in combination with the T-bar steel laminated core in accordance with the present invention.

Looking at FIG. 10, for example, it will be noted that the T-shaped core member is oriented such that the cross-bar member is received within the channel member 210, and that the head of the cross-bar member 308 comes to rest with the tapered side walls 302 in such a manner that the top of the head is just below the stop wall 216, and that the ramp 304 at the other end of the T-bar member 300 is inclined in a manner to correspondingly receive the ramp portion 106 of the C-shaped core and is fitted within the lower guide rails 230. It will also be noted from FIG. 10 that the plate-like permanent magnet member 310, being of the same width and length as the top of the cross-bar member can be slid into place from the open side of the channel members whereupon it will come to rest at the stop wall 216. While it is preferred that the protrusions 312 on the permanent magnet be located so as to engage the C-shaped core member, the coil assembly would work equally well if the protrusions were facing the cross-bar member. Forming the protrusions on the interengaging surface of the core member 300 is also an alternative.

Figure 8:
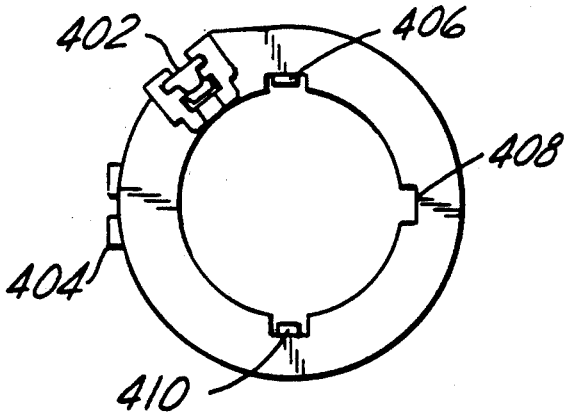
FIG. 8 is a plan view of the secondary bobbin and winding assembly shown in FIG. 7 as viewed from the upper end thereof.
Figure 7:
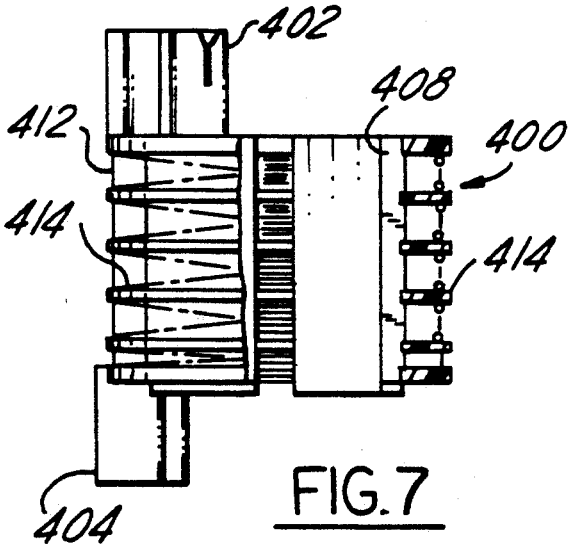
FIG. 7 is an elevation view of the secondary bobbin and winding assembly in accordance with the present invention.
Figure 10A:
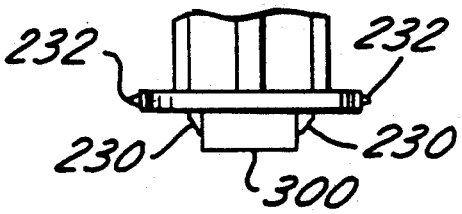
Figure 9:
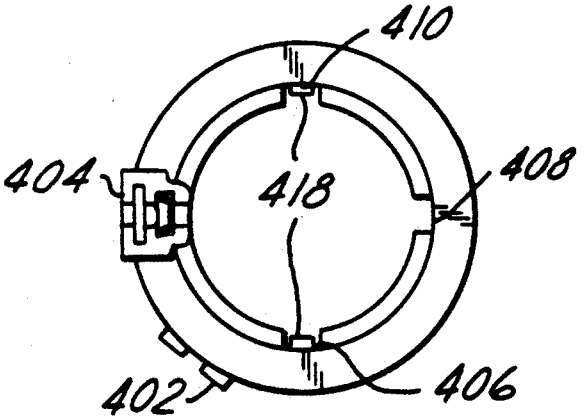
FIG. 9 is a plan view of the secondary bobbin and winding assembly shown in FIG. 7 as viewed from the bottom thereof.
Figure 11:
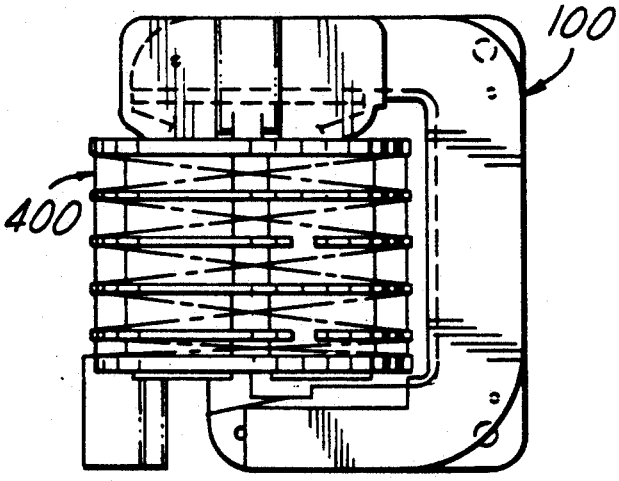
FIG. 11 is an elevation view of the primary and secondary bobbin and winding assemblies in combination with the laminated core assembly components in accordance with the present invention.

Looking at FIGS. 7–9, there is shown the details of the secondary bobbin 400 and winding assembly. Like the primary coil bobbin, the secondary coil bobbin is an integral injection molded plastic member, preferably made of nylon or similar material. It is generally cylindrical, with the inner diameter being sized to closely receive the primary bobbin assembly and including a plurality of elongated slots 406, 408, 410 extending completely through the side wall of the bobbin. The input and output terminal portions 402, 404 are located at respective ends of the bobbin. The bobbin includes a plurality of annular ribs 414 for maintaining the location of the coil as it is wound annularly over the bobbin. The slots 406, 408, 410 are adapted to receive the locating lugs 218, 220, 222 respectively of the primary bobbin assembly as earlier explained. Further, after assembly of all components, when the ignition coil assembly is to be filled with the potting material pursuant to conventional practice, the potting material will flow within the elongated slots on the inner portion of the secondary bobbin assembly and radially through to all inner portions of the secondary winding, thus enhancing the efficient filling of the coil assembly and eliminating all voids within the components.

Figure 12:
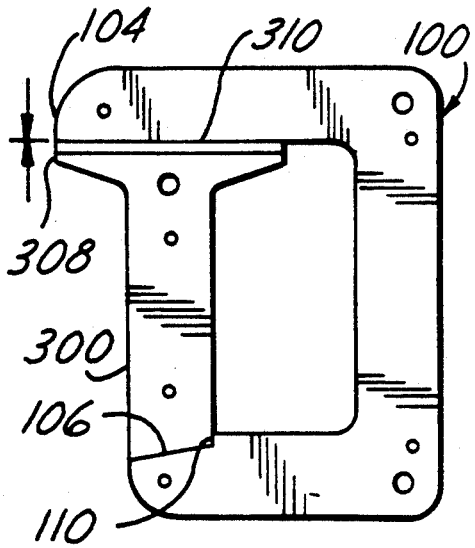
FIG. 12 is an elevation view showing only the assembly of the steel laminated C-shaped core, and T-shaped core, in combination with the permanent magnet in accordance with the present invention.

In FIG. 12 there is shown just the assembly of the steel laminated core members 100, 300 and the permanent magnet 310. It will be noted that the C-shaped core member 100 includes at one end portion a ramp 106 which terminates at a stop shoulder 110. The width of the ramp is designed to match that of the T-shaped cross-member so that upon assembly the core members will be flush at the outer periphery.

Also from FIG. 12, it is noted that no air gaps exist between the permanent magnet 310 and the other terminal end portion 104 of the C-shaped core member. This is the ideal design condition in accordance with the present invention. However, due to normal component tolerances stack up, it would not be abnormal to find during production that an extremely minor air gap does exist between the permanent magnet 310 and the C-shaped coil member for a limited number of coil assemblies. To eliminate even this possibility, the permanent magnet is provided with a number of protrusions 312 which extend outwardly from the permanent magnet a distance equal to or slightly exceeding the maximum differential in stack up of dimensional tolerances of the components, i.e. the collective maximum difference between the minimum and maximum tolerances on each component. When the core members are assembled with the minimum stack-up tolerance differential, the protrusions will be completely flattened over the surface of the permanent magnet under the force of the T-bar member 300 being forced along the ramp portion 106. On the other hand, when the maximum tolerance differential exists thereby allowing what would otherwise be an air gap between the core members 100, 300, the protrusions 312 of the permanent magnet 310 will still come into contact with the C-shaped coil member and the air gap will be virtually eliminated or the air gap will be present only in the area of the greatest cross-sectional area of the T-bar core member 300, which is the cross-bar portion 308.

Figure 13:
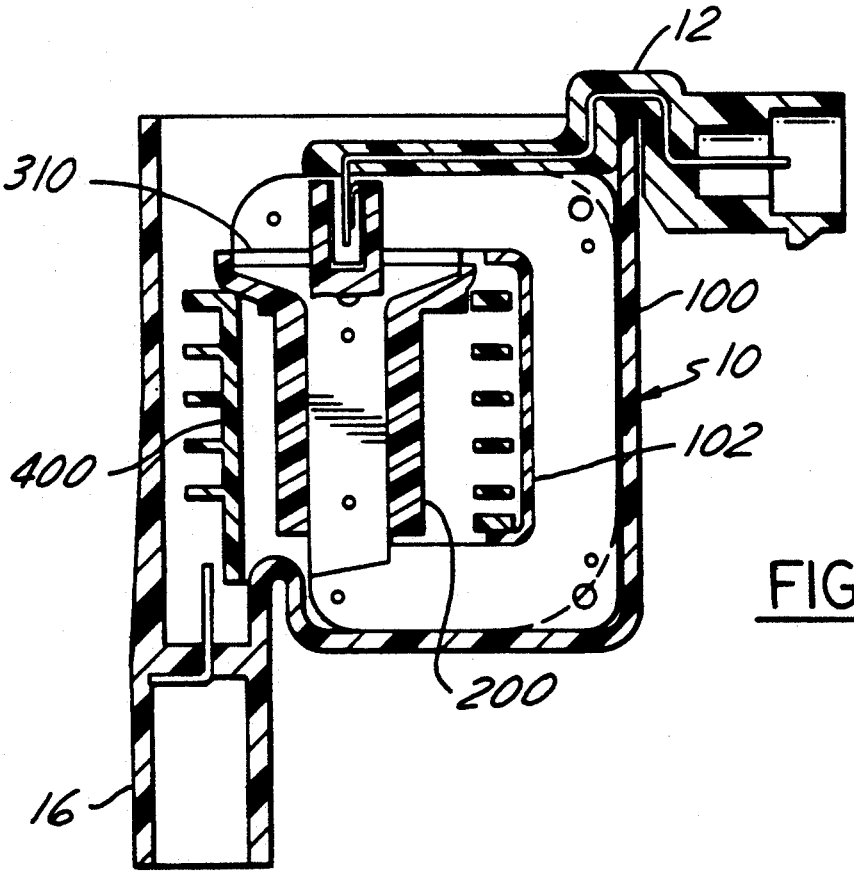
FIG. 13 is an elevation view, shown in section, of the entire ignition coil assembly in accordance with the present invention, but excluding any showing of the lower boot member.

FIG. 13 shows a cross-section of the ignition coil assembly previously described. It will be noted that no air gap exists between the permanent magnet 310 and either core members 100, 300. It will be noticed that the primary coil bobbin member 200 is precisely and compactly located within the annular secondary coil bobbin member 400 and that the primary and secondary bobbin assemblies are closely nestled within the open portion of the C-shaped member 100. Further, it will be noted how the thermal insulating clip 102 insulates the secondary winding assembly precluding the possibility of thermal stress generated by the heat and resultant expansion of the C-shaped core member from causing any stress cracking which might otherwise cause a short circuit between the C-shaped core member and the secondary winding.

Figure 14:
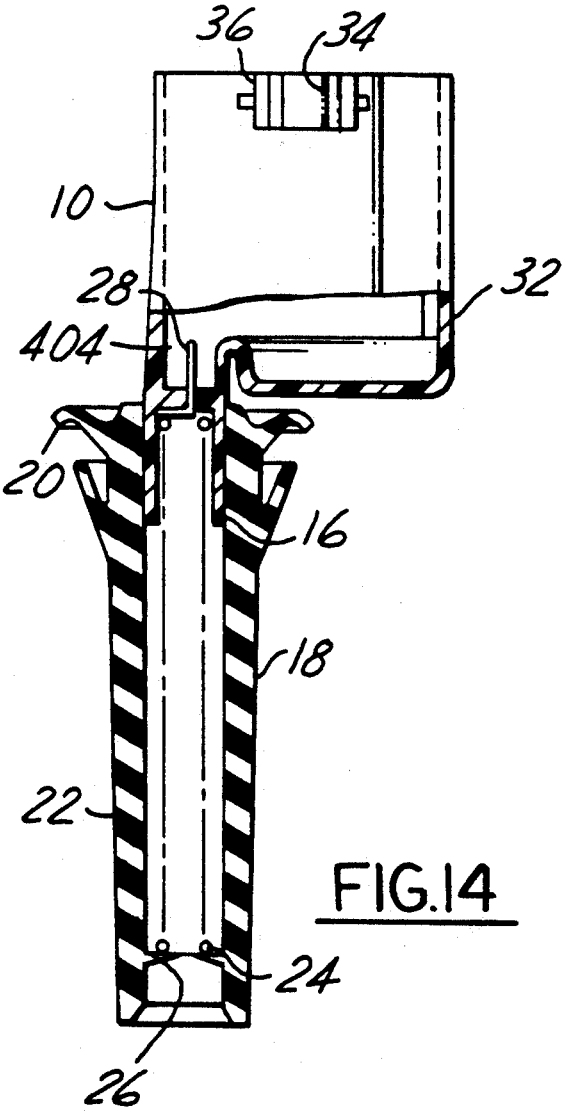
FIGS. 14 and 14a are an elevation view shown partially in section of the housing, less the inner iron core and bobbin assemblies, and in combination with the lower boot member, in accordance with the present invention.
Figure 14A:
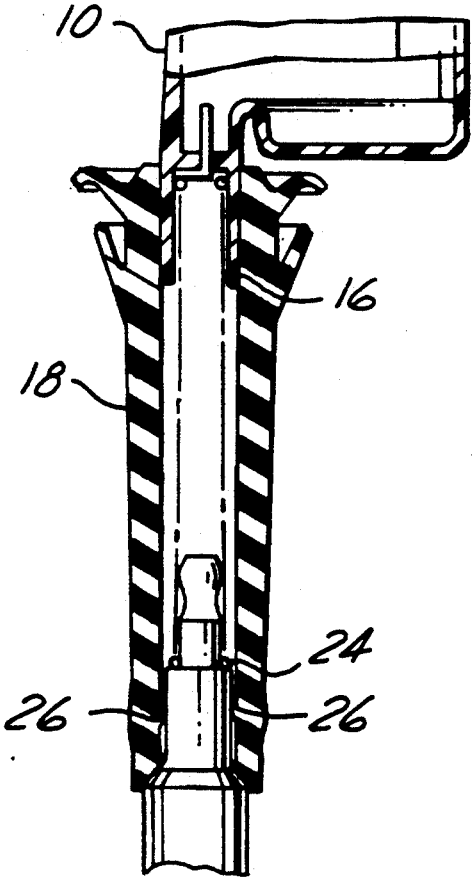

FIG. 14 illustrates another important feature of the subject invention, mainly the manner in which the rubber boot member 18 is adapted to be slip-fit onto the housing portion 16 and to loosely retain the retainer spring 24 by virtue of its being completely open at one end and concluding at its other end at an annular integral rubber inwardly directed lip 26 which acts as a spring arrest. Thus, the retaining spring may be slipped into the boot from the end opposite the spring arrest lip 26. The spring is loose fit within the housing terminal portion 16 and a of sufficient non-compressed length to come into loose contact with the half-moon shaped base 28 of the secondary coil output terminal 404. Thereafter, when the spark plug is inserted at the opposite end of the boot 18, the spring 24 will be forced into electrical contact between the secondary coil output at one end and the spark plug head at the other end. The arrest lip 26 is constructed with sufficient radial dimension such that the spring will be retained within the boot when the spark plug is detached from the boot assembly.

Also shown at the lower portion of the annular housing member 10 is a molded-in-place core receiving well 30 having a pair of oppositely disposed side walls 32, one of which is shown, spaced from one another sufficiently to closely receive the lower portion of the C-shaped core member 100 and retain the coil member in fixed position relative to the housing.

Figure 15:
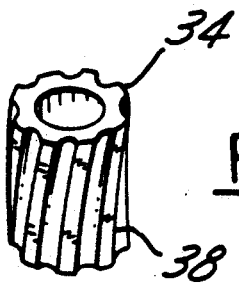
FIG. 15 is a perspective view of the housing mounting member boss bushing which is injection molded into the housing mounting member arm and boss assembly in accordance with the present invention.

FIGS. 14 and 15 show a uniquely constructed powdered metal sintered bushing 34 to be injection molded into the housing mounting member 36. The bushing includes a plurality of helical retention ribs 38 spaced about the circumference of the bushing. Any tendency of the bushing 34 to turn in the housing is thereby precluded as well as any tendencies toward axial displacement.

While the best mode for carrying out the invention has been described in detail, those familiar with the art to which this invention relates will recognize various alternative designs and embodiments for practicing the invention as defined by the following claims.

We claim:

1. An ignition coil comprising:

a C-shaped iron core member defining an air gap between the terminal ends of the C-shaped member;

a coil sub-assembly within said air gap comprising a primary coil member and a secondary coil member;

both said primary coil member and said secondary coil member comprising a bobbin and a plurality of windings of electromagnetic material being wound about the axis of each said bobbin, said primary winding member received telescopically within said secondary winding member; and said primary coil member including a permanent magnet member disposed at one end of said bobbin and in intimate contact with said C-shaped core member at both its ends and thereby completely filling said air gap, said permanent magnet member being made of a magnetic material dispersed within an electrically non-conductive matrix and being at substantially less than full density within said matrix.

2. The invention of claim wherein said permanent magnet member is made of a powdered magnetic material having a flux density of about 4.2 kilogauss.

3. The invention of claim 1 wherein said permanent magnet member is made of a plurality of grains of magnetic material selected from the group consisting of neodymium and samarium and dispersed within a plastic matrix.

4. An ignition coil adapted for use with an internal combustion engine comprising:

a C-shaped iron core member defining an air gap between the terminal ends of the C-shaped member;

a coil sub-assembly within said air gap comprising a primary coil member and a secondary coil member;

both said primary coil member an said secondary coil member comprising a bobbin and a plurality of windings of electromagnetic material being wound about the axis of each said bobbin, said primary coil member being received telescopically within said secondary coil member;

said primary coil member including a T-shaped core member slidingly disposed along the cylindrical axis of said bobbin and in line contact with a through-bore of said bobbin, said T-shaped core member including a pair of oppositely disposed ends, one said end residing at the base end of said T-shaped member and the other end comprising the crossbar portion of said T-shaped member;

a permanent magnet member located at said crossbar end of said T-shaped member;

said permanent magnet member being in intimate contact with one terminal end portion of said C-shaped core member and one of said oppositely disposed ends of said T-shaped core member, and said T-shaped core member at its other end being in intimate full line contact with the other terminal end of said C-shaped core member; and one of said permanent magnet member and said C-shaped core member including means for eliminating completely any air gap between the terminal end of said C-shaped core member and the base end of said T-shaped core member.

5. The invention of claim 4 wherein said base end of the T-shaped core member comprises an end surface inclined at an acute angle relative to the axis of said T-shaped member, and the respective terminal end of said C-shaped core member being inclined at the same acute angle to thereby define a pair of inclined ramp surfaces in line contact with one another whereby upon assembly of the coil subassembly within the air gap of said C-shaped core member, common manufacturing stack-up tolerances in the respective components which are normally determinative of the extent of the air gap between the members can be eliminated and a zero air gap provided as the corresponding tapered end surfaces of said core members are juxtaposed relative to one another in a final assembled position; and said permanent magnet member including means for eliminating the effect of any tolerance in the air gap and assuring intimate line contact with the terminal end portion of said C-shaped iron core member.

6. The invention of claim 5 wherein said permanent magnet member is a flat magnetic plate, said means for eliminating said air gap including a plurality of protrusions extending from one surface of said magnetic plate, said protrusions being deformable during assembly of the coil sub-assembly within the C-shaped core member under the force of bringing said inclined ramp surfaces into full line contact with one another at the opposite end of said C-shaped core member.

7. An ignition coil adapted for use with an internal combustion engine and in association with and operatively connected to a single spark plug, comprising:

a C-shaped iron core member comprising a plurality of C-shaped laminations stacked side-to-side in intimate contact one with the other, and defining an air gap between the terminal ends of the C-shaped member;

a coil sub-assembly within said air gap comprising a primary coil member and a secondary coil member;

both said primary coil member and said secondary coil member comprising a bobbin and a plurality of windings of electromagnetic material being wound about the axis of each said bobbin, said primary coil member being received telescopically within said secondary coil member;

said primary coil member including a permanent magnet member disposed at one end of said bobbin and in intimate contact with said C-shaped core member, said permanent magnet member being made of a powdered magnetic material evenly dispersed within an electrically non-conductive matrix and being at substantially less than full density within said matrix;

said primary coil member including a T-shaped core member slidingly disposed along the cylindrical axis of said bobbin and in line contact with a through-bore of said bobbin, said T-shaped core member including a pair of oppositely disposed ends, one said end residing at the base end of said T-shaped member and the other end comprising the crossbar portion of said T-shaped member;

said permanent magnet member being located at said crossbar end of said T-shaped member;

said permanent magnet member being in intimate contact with one terminal end portion of said C-shaped core member and one of said oppositely disposed ends of said T-shaped core member, and said T-shaped core member at its other end being in intimate full line contact with the other terminal end of said C-shaped core member; and one of said permanent magnet member and said C-shaped core member including means for eliminating completely any air gap between the terminal end portions of said C-shaped core member and the base end of said T-shaped core member.

8. The invention of claim 7 wherein said permanent magnet member is made of a powdered magnetic material having a flux density of about 4.2 kilogauss.

9. The invention of claim 8 wherein said permanent magnet member is made of a plurality of grains of magnetic material selected from the group consisting of neodymium and samarium and said matrix is plastic.

10. The invention of claim 9 wherein said base end of the T-shaped core member comprises an end surface inclined at an acute angle relative to the axis of said T-shaped member, and the respective terminal end of said C-shaped core member being inclined at the same acute angle to thereby define a pair of inclined ramp surfaces in line contact with one another whereby upon assembly of the coil subassembly within the air gap of said C-shaped core member, common manufacturing stack-up tolerances in the respective components which are normally determinative of the extent of the air gap between the members can be eliminated and a zero air gap provided as the corresponding tapered end surfaces of said core members are juxtaposed relative to one another in a final assembled position; and said permanent magnet member including means for eliminating the effect of any tolerance in the air gap and assuring intimate line contact with the terminal end portion of said C-shaped iron core member.

11. The invention of claim 10 wherein said permanent magnet member is a flat magnetic plate, said means for eliminating said air gap including a plurality of protrusions extending from one surface of said magnetic plate, said protrusions being deformable during assembly of the coil sub-assembly within the C-shaped core member under the force of bringing said inclined ramp surfaces into full line contact with one another at the opposite end of said C-shaped core member.

12. An ignition coil comprising:

a housing of molded plastic material;

a coil assembly within said housing and including a C-shaped electromagnetic core member defining an open cavity, and a coil sub-assembly positioned within said open cavity;

said coil sub-assembly comprising a primary coil member and a secondary coil member;

said housing including at least one mounting member fixed to said housing;

an annular bushing injection molded into said housing mounting member;

said bushing having a through-bore throughout the length of said bushing to thereby receive a mounting bolt or similar member for securing said ignition coil to a support structure and said bushing further including a rib means protruding from the periphery thereof and embedded within said mounting member whereby said bushing is restrained from axial and rotational displacement in relation to said housing.

13. The coil of claim 12 wherein said bushing rib means includes a plurality of helical retention ribs protruding from said bushing and spaced about the circumference of said bushing.

14. An ignition coil comprising:

a housing of molded plastic material;

a coil assembly within said housing and including a C-shaped electromagnetic coil member defining an open cavity, and a coil sub-assembly positioned within said open cavity;

said coil sub-assembly comprising a primary coil member and a secondary coil member;

said housing including an annular stem portion having a secondary coil output lead at one end thereof nearest the remainder of said housing;

an annular, flexible, electrically non-conductive boot member slidingly received onto said housing stem portion at one end and adapted to receive and hold in place a spark plug at its other end;

a retaining spring slidingly received within said boot member and adapted to grip the spark plug to thereby assist in holding the spark plug in place and establishing electrical contact between said coil assembly and the spark plug; and means for loosely retaining said retaining spring within said boot member.

15. The invention of claim 14 wherein said means for loosely retaining said retaining spring includes an annular arresting lip molded as an integral part of said boot member and projecting radially within said boot member whereby said retaining spring may rest upon said lip when no spark plug is held within the boot member.

16. An ignition coil comprising:

a C-shaped iron core member defining an air gap between the terminal ends of the C-shaped member;

a coil sub-assembly within said air gap comprising a primary coil member and a secondary coil member;

both said primary coil member and said secondary coil member comprising an annular bobbin and a plurality of windings of electromagnetic material being wound cylindrically about the axis of each said bobbin, said primary winding member received telescopically within said secondary winding member; and said primary coil member including a permanent magnet member disposed at one end of said bobbin and in intimate contact with said C-shaped core member.

17. The invention of claim 16 wherein said permanent magnet member is comprised of a magnetic material that is substantially less than fully dense.

18. The invention of claim 16 wherein said primary coil member further includes:

a T-shaped iron core member including a pair of oppositely disposed ends, one said end residing at the base end of said T-shaped member and the other end comprising the crossbar portion of said T-shaped member;

a permanent magnet member located at said crossbar end of said T-shaped member;

said permanent magnet member being in intimate contact with one terminal end portion of said C-shaped core member, and one of said oppositely disposed ends of said T-shaped core member, and said T-shaped core member at its other end being in intimate full line contact with the other terminal end of said C-shaped core member; and said permanent magnet member and said C-shaped core member including means for eliminating completely any air gap between the terminal end portion of said C-shaped core member and the base end of said T-shaped core member.

19. An ignition coil adapted for use with an internal combustion engine and in association with and operatively connected to a single spark plug, comprising:

a C-shaped iron core member comprising a plurality of C-shaped laminations stacked side-to-side in intimate contact one with the other, and defining an air gap between the terminal ends of the C-shaped member;

a coil sub-assembly within said air gap comprising a primary coil member and a secondary coil member;

both said primary coil member and said secondary coil member comprising an annular bobbin and a plurality of windings of electromagnetic material being wound cylindrically about the axis of each said bobbin, said primary winding member being received telescopically within said secondary winding member;

said primary coil member including a permanent magnet member disposed at one end of said bobbin and in intimate contact with said C-shaped core member, said permanent magnet member being made of a magnet material that is substantially less than fully dense;

said primary coil member including a T-shaped core member slidingly disposed along the cylindrical axis of said bobbin and in line contact with a through-bore of said bobbin, said T-shaped core member including a pair of oppositely disposed ends, one said end residing at the base end of said T-shaped member and the other end comprising the crossbar portion of said T-shaped member;

said permanent magnet member being located at said crossbar end of said T-shaped member;

said permanent magnet member being in intimate contact with one terminal end portion of said C-shaped core member and one of said oppositely disposed ends of said T-shaped core member, and said T-shaped core member at its other end being in intimate full line contact with the other terminal end of said C-shaped core member; and said permanent magnet member and said C-shaped core member including means for eliminating completely any air gap between the terminal end portion of said C-shaped core member and the base end of said T-shaped core member.

20. The invention of claim 19 wherein said permanent magnet member is made of a magnetic material having a flux density of about 4.2 kilogauss.

21. The invention of claim 20 wherein said permanent magnet member is made of a plurality of grains of magnetic material selected from the group consisting of neodymium and samarium and wherein said grains of magnetic material are substantially evenly dispersed within a plastic matrix constituting the remainder of said permanent magnet member.

22. An ignition coil comprising:

an iron core member defining an open cavity and air gap across said open cavity between two opposed portions of the core member;

a coil sub-assembly within and completely filling said air gap and comprising a primary coil member and a secondary coil member;

both said primary coil member and said secondary coil member comprising a bobbin and a plurality of windings of electromagnetic material being wound about the axis of each said bobbin, said primary winding member received telescopically within said secondary winding member; and said primary coil member including a permanent magnet member disposed at one end of said bobbin and in intimate contact with said core member at both its ends and thereby completely filling said air gap, said permanent magnet member being made of a magnetic material dispersed within an electrically non-conductive matrix and being at substantially less than full density within said matrix.

23. An ignition coil comprising:

a C-shaped iron outer core member defining an air gap between the terminal ends of the C-shaped member;

a coil sub-assembly within said air gap comprising a primary coil member and a secondary coil member;

both said primary coil member and said secondary coil member each comprising an annular bobbin and a plurality of windings of electromagnetic material being wound cylindrically about the axis of each said bobbin, said primary winding member received telescopically within said secondary winding member;

an inner core member;

said inner core member extending through said primary coil member bobbin and substantially filling said air gap and being in intimate contact with at least one of said terminal ends of said C-shaped core member.

* * * * *